United States Patent [19]

Eichweber

[11] Patent Number: 4,561,849

[45] Date of Patent: Dec. 31, 1985

[54] DEVICE FOR SIMULATING COMBAT FIRING BETWEEN COMBAT PARTICIPANTS

[75] Inventor: Kurt Eichweber, Hamburg, Fed. Rep. of Germany

[73] Assignee: Precitronic Gesellschaft fur Feinmechanik und Electronic mbH, Hamburg, Fed. Rep. of Germany

[21] Appl. No.: 534,296

[22] Filed: Sep. 21, 1983

[30] Foreign Application Priority Data

Sep. 21, 1982 [DE] Fed. Rep. of Germany ..... 3234949

[51] Int. Cl.[4] ..... G09B 9/00

[52] U.S. Cl. ..... 434/22; 273/311

[58] Field of Search ..... 273/310–316; 434/20–22

[56] References Cited

U.S. PATENT DOCUMENTS

| | | | |
|---|---|---|---|
| 3,315,689 | 2/1967 | Goda | 356/141 |
| 3,832,791 | 9/1974 | Robertsson | 434/22 |
| 3,877,157 | 4/1975 | Ashford et al. | 35/25 |
| 3,898,747 | 8/1975 | Marshall | 434/22 |
| 3,907,433 | 9/1975 | Nault | 356/152 |
| 3,927,480 | 12/1975 | Robertsson | 35/25 |
| 3,956,582 | 6/1976 | von Bennigsen | 35/25 |
| 4,053,929 | 10/1977 | Collins, III et al. | 358/126 |
| 4,063,368 | 12/1977 | McFarland | 434/22 |
| 4,189,747 | 2/1980 | Funari | 358/126 |
| 4,218,834 | 8/1980 | Robertsson | 35/25 |
| 4,227,261 | 10/1980 | Robertsson | 273/312 |
| 4,246,705 | 1/1981 | Lee | 434/22 |
| 4,342,556 | 8/1982 | Hasse | 434/22 |
| 4,478,581 | 10/1984 | Goda | 434/22 |

FOREIGN PATENT DOCUMENTS

| | | |
|---|---|---|
| 2148157 | 4/1973 | Fed. Rep. of Germany . |
| 2262605 | 7/1973 | Fed. Rep. of Germany . |
| 3028545 | 2/1982 | Fed. Rep. of Germany . |

*Primary Examiner*—Richard C. Pinkham
*Assistant Examiner*—Leo P. Picard
*Attorney, Agent, or Firm*—Arnold, White & Durkee

[57] ABSTRACT

A device is disclosed for combat simulation, in which each weapon carrying combat participant has a laser transmitter, an optical measurement receiver, and an analyzer, and each target object combat participant has reflector elements, an optical information receiver and a device for evaluating the optical information. When firing is simulated, the target is tracked with laser pulses which are transmitted by the laser transmitter and reflected by the reflector elements back to the measurement receiver. The hit accuracy information is optically coded and sent back to the target. According to this invention, optical signals or beams for target tracking and for information transmission are spatially separated from each other by distributing the reflector elements in the vulnerable area of the target, but locating the optical information receiver separately, preferably in an exposed location. The reflector elements may be inexpensive disposable elements. Signal transmission between the various components can be accomplished by optoelectronic links without the use of cables. On receipt of a "hit" signal, an optoelectronic link which activates the laser transmitter can be unavoidably switched off to inactivate the combat participant that has been hit without any possibility of tampering by the combat participant to prevent this.

14 Claims, 8 Drawing Figures

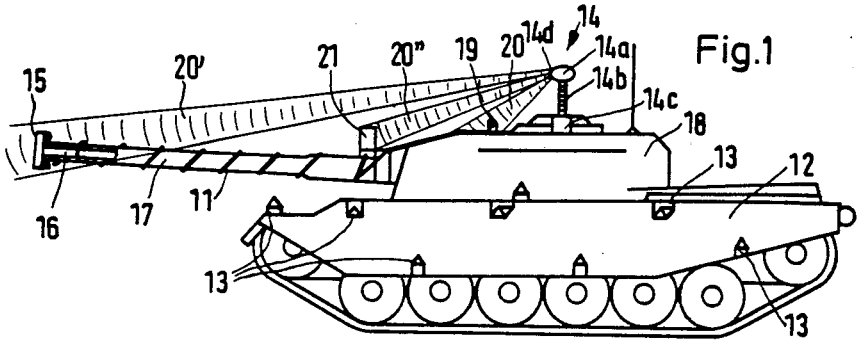
Fig.1
Fig.2
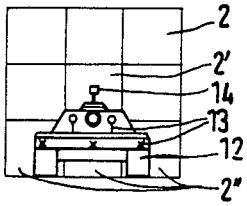
Fig.3
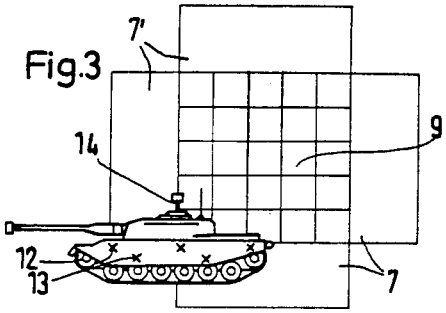
Fig.4
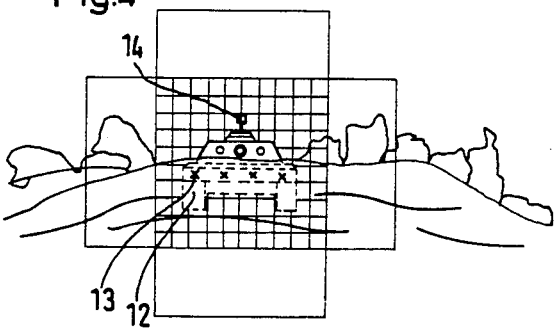
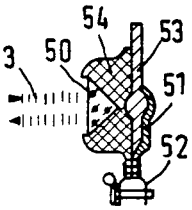
Fig.6
Fig.5
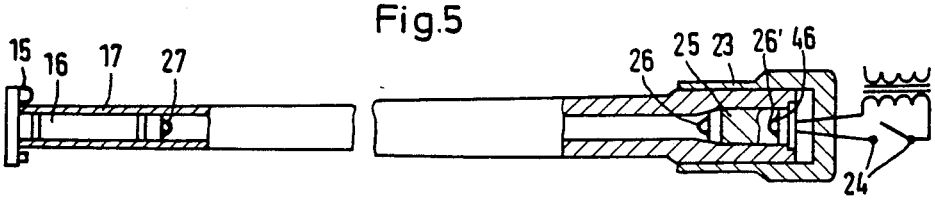

DEVICE FOR SIMULATING COMBAT FIRING BETWEEN COMBAT PARTICIPANTS

BACKGROUND OF THE INVENTION

This invention generally relates to combat simulation devices. More particularly, this invention concerns a device for simulating combat firing between combat participants in which a weapon carrier participant has a laser transmitter for transmitting laser pulses which measure the position of a target object in the simulated firing operation, an optical measurement receiver for receiving laser pulses reflected by the target object, and an analyzing device for evaluating hit accuracy information which is then transmitted by coded laser pulses to the target object. The target object is provided with reflector elements to reflect the laser pulses as well as at least one optical information receiver for receiving coded laser pulses and analyzing hit accuracy information contained therein. The laser transmitters make it possible to measure the target in three planes, where the X-Y plane is represented primarily by a matrix scanning field of differentially coded beams.

With such devices, e.g., those known from German Patent (DE-AS) Nos. 2,148,157 and 2,262,605, a plurality of units consisting of one reflector element and one receiving sensor are mounted on the target object in a distributive pattern to assure reception and reflection on all sides. However, this requires a great deal of electrical cable for supplying power to and transmitting information from the numerous receiving sensors.

The supply cables, including all the required plug-type connections, are expensive and time consuming to install. They must be produced separately to fit different sizes of target vehicles, and must be resupplied logistically. The shipping weight and volume are considerable, comprising a substantial portion of the possible capacity of the shipping containers and of the shipping costs.

Practice has shown that more than 90% of the damage to cables and plug connectors occurs during official service use. The cable shields or protective sheathing with their ground connection lines also endanger the overall electronic system because they also function as antennas for strong radar or pulse fields. This results in problems in passive electromagnetic compatibility in a variety of ways.

In addition, these units and their supply cables are especially susceptible to damage during combat simulation maneuvers because of the exposed mounting locations.

The fact that simulators are mounted on about 30–40 different types of target vehicles, but mainly on armored vehicles, and that each vehicle requires special holders and cable lengths for existing simulation systems, indicates clearly that other solutions would be desirable. The holders, together with the usual combined optical receivers and reflectors, take up a substantial volume and are quite heavy. Along with the required cables, they are many times larger than the other simulation system components.

On the other hand, it is also known from German Patent (DE-OS) No. 3,028,545 that a single reflection-receiver unit with all-around reception and reflection properties can be provided at the target object. However, because the reflector and receiver functions are carried out by a single unit, the target object receives no warning that it is under attack unless a direct hit is made on its vulnerable area; i.e., where the reflector-receiver unit is located. Thus, the reflection-receiver unit does not produce realistic combat conditions.

Another disadvantage of these known devices is their high expense, complex assembly and great susceptibility to interference because of the required cable connections with plug-type connectors. These cable connections are required not only between the above-mentioned distributed information receiver units and a central analyzer or indicator unit, but also between these components and the laser transmitter and measurement receiver when these are mounted on the same combat participant, which is then functioning simultaneously as a weapon carrier and a target object.

Another disadvantage of known devices is that there is no adequate assurance that a combat participant which has been hit by a simulated shot will be deactivated and eliminated from combat. Previous systems have permitted combat trainee tampering whereby, despite the presence of a definite hit signal (e.g., by an audible beep, a pyrotechnic smoke display, etc.), the combat participant in question continues to be capable of participating in the simulated combat maneuvers because his laser firing simulator is not deactivated.

SUMMARY OF THE INVENTION

This invention provides a device of the general type described initially which permits a substantial simplification of design and assembly with improved operating reliability and reduced costs. Further, the simulation device of this invention increases the realistic fidelity of the target practice, especially with regard to accurate measurement of the target position with each stimulated shot. The device also assures that a combat participant which has been hit will be deactivated.

According to one embodiment of the present invention, there is provided a device for simulating firing combat between combat participants, each of which is either a weapon carrier, a target object, or both. In association with the weapon carrier, the device comprises a laser transmitter means for transmitting laser pulses to track the position of the target object, optical measurement receiver means for receiving the tracking laser pulses reflected by the target object, analyzer means for analyzing from the reflected laser pulses information concerning hit accuracy, and means for transmitting the hit accuracy information to the target object by coded laser pulses. The device further comprises, in association with the target object, reflector element means for reflecting the tracking laser pulses, at least one optical information receiver means for receiving the coded laser pulses, and means coupled to the optical information receiver means for evaluating the hit accuracy information transmitted by the coded laser pulses. The reflector element means are separate from and located in space relationship from the optical information receiver means.

A basic feature of the device according to this invention consists of having the reflector elements separate from the information receiver and set up some distance apart from it. In particular, in another embodiment of the invention, the reflector element means is located in the vulnerable area of the target object and the information receiver means is positioned at an exposed point outside the vulnerable area of the target object.

In a further embodiment, the reflector element means, which is separate from the information receiver means, comprises a plurality of reflector elements that do not require any cable connections. They can be designed as inexpensive, disposable parts that can be replaced on the target object by means of easily removable mounting fixtures. These mounting fixtures also permit the position of the reflector elements to be easily varied as needed. When the device is used on an armored vehicle, the reflector elements can be placed in the vicinity of the running gear and the information receiver means can be placed on a stand projecting above the turret. The reflector elements can be inexpensive, stick-on reflector films, cat's eye reflectors, or similar devices, depending upon the type of firing and weapons effect to be simulated. The advantages of using simple reflector elements is especially realized in simulating infantry combat.

In another embodiment of the device according to the present invention, the combat participant is both a weapon carrier and a target object simultaneously. The laser transmitter means and optical measurement receiver means are combined in one laser transmitter-receiver unit.

According to another embodiment of this invention, means is provided for transmitting data or information from the information receiver means to the laser transmitter-receiver unit, as well as to other optional display units, without the use of cables and preferably completely without cables, by optoelectronic communications links.

In still a further embodiment of the invention, the information receiver means has a controllable light source means for transmitting a light signal for deactivating the laser transmitter-receiver unit on receipt by the information receiver means of a strike signal relayed by another combat participant. The laser transmitter-receiver unit has an optical sensor means for receiving the light signal.

This assures that when a combat participant is hit, human tampering cannot prevent the participant from being put out of action. The latter possibility exists with known simulators for infantry weapons, for example, where a signal whistle is produced on the instrument after a strike and the trainee that is hit must turn off the signal himself. Experience with the Miles system in the U.S. Army has shown that soldiers do not do this.

Special assurance that such tampering will be prevented is provided by another embodiment of this invention in which the light source means that is controlled by the information receiver either continuously or periodically transmits activating light signals to the laser transmitter-receiver unit so that reception and decoding of a strike signal causes transmission of the activating light signal to be terminated. Because the laser transmitter-receiver unit is active only during receipt of the activating signal, the unit is deactivated by its absence. This version is especially advantageous for a lightweight weapon firing simulator, such as a rifle, eliminating many cable connections, which are especially annoying in these applications, and also permitting realistic simulation.

In still another embodiment of the invention, the information receiver means has a light source means for transmitting coded light signals upon receipt by the information receiver means of tracking laser pulses from another combat participant. The simulation device further has periscope means for deflecting the coded light signals into the interior of the target object and a firing display means in the interior of the target object for receiving and displaying the coded light signals.

In another embodiment of the device according to the present invention, the information receiver means has an associated light source means for transmitting a light signal upon receipt of a hit signal by the information receiver means from another combat participant. The device further comprises a hit display means for receiving the light signal and for producing, in response thereto, a hit display.

A preferred location for setting up the laser transmitter-receiver unit is the front end of a weapon, which may be a tank cannon, for example. With known simulation devices, cable connections were required in such a case for the data and command transmission to the laser receiving unit, especially for transmission of the shot firing command. In another embodiment of this invention, cable connections can be eliminated by providing an optoelectronic transmission link between a shot firing button of the weapon and the laser transmitter-receiver unit.

This link is preferably designed so that no changes are necessary in the breech of the weapon and the simulated shot is triggered in precisely the same manner, with the same shot-triggering button, as is the case in firing an actual shot from the weapon. Therefore, according to a further embodiment of this invention, instead of a shell or a cartridge case, a dummy cartridge with a light source that can be activated by the firing button can be used in the breech, and the laser transmitter-receiver unit has a sensor means for receiving the optical triggering signal of the light source transmitted within the barrel of the weapon. This version is especially advantageous because it permits, for the first time, team integration of the marksman with his operations in the training process.

The device according to this invention can also be designed for combat simulation with hand guns, where the reflector elements are placed on the body of the marksman, the information receiver means on his helmet and the laser transmitter-receiver unit on the weapon. A light source means on the helmet transmits an activating light signal to the transmitter-receiver unit which is received by optical sensor means on the unit when the weapon is held in the usual firing position.

Versions of this invention are explained in detail below with reference to the figures.

BRIEF DESCRIPTION OF THE DRAWINGS

FIG. 1 shows an armored vehicle equipped with the device according to this invention.

FIGS. 2, 3 and 4 show an armored vehicle according to FIG. 1 in various combat positions relative to the laser beam field of another combat participant.

FIG. 5 shows a preferred version for cable-free triggering of a laser firing simulator.

FIG. 6 shows the mechanical mounting of a reflector element.

DETAILED DESCRIPTION OF THE PREFERRED EMBODIMENTS

Figure 8:
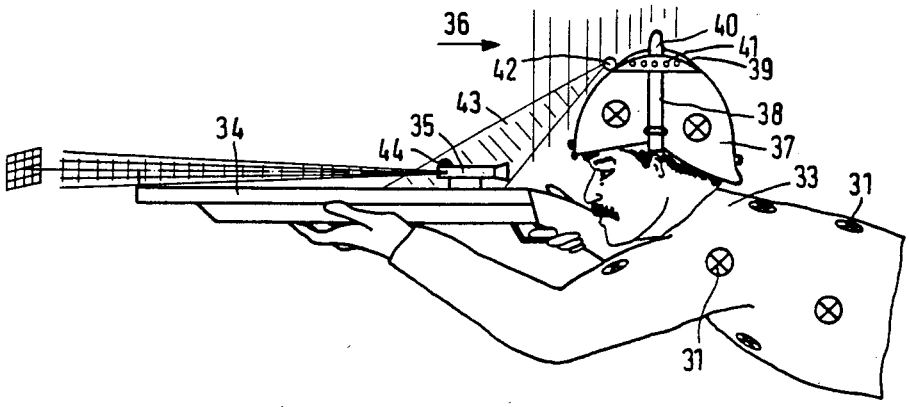
FIG. 8 shows an infantry combat participant equipped with a combat simulation device according to this invention.

According to FIG. 1, an armored vehicle 12 is equipped with the device according to the present invention for the purpose of combat firing simulation by means of laser beams. A number of reflector elements 13 are mounted and distributed on the vehicle 12 in the preferred combat zone for training purposes, i.e., the zone which includes the vulnerable areas of an armored vehicle. This zone may include, for example, the vicinity of the gear mechanism. The combat zone as defined by reflector elements 13 serves as the point for aiming the weapon in actual combat. The reflector elements 13 are designed (e.g., as triple reflector prisms) so that they can reflect incident optical radiation coming from any angle back in exactly the same direction.

A laser transmitter-receiver unit 16 is located in the front end of the weapon 17 of the armored vehicle and has a laser transmitter for transmitting coded laser pulses which fill out a solid angle with differently coded matrix fields. Unit 16 also has a measurement receiver for receiving reflected laser pulses. The laser transmitter-receiver unit 16 is paired with analyzer means in the form of an analyzer unit (not shown) which collects information from the transit time of laser pulses reflected by the target object and received by the measurement receiver. From the coding of the laser pulses, the analyzer determines the distance from the target object struck as well as its angular position with regard to the axis of bore of the weapon. Then, by taking into account other data, such as the type of ammunition, the analyzer decides in a known manner whether this is a hit or a miss. This information regarding hit accuracy can then be imprinted as pulse coding on a laser signal transmitted by the laser transmitter-receiver unit and received by the target object.

The analyzer unit can be set up separately from the laser transmitter-receiver unit 16 and connected to it by cable. In a preferred version, however, it is combined directly with the laser transmitter-receiver unit so that no separate cable connections are necessary.

An optical information receiver means in the form of an information receiver 14 is set up in an exposed position on a turret 18 of armored vehicle 12 and has a receiver head 14*a* set up in an elevated position on a stand 14*b*. Receiver head 14*a* has an all-around reception capability and can be connected with a power supply and/or an analyzer unit 14*c* set up at the base of stand 14*b*.

The information receiver 14 receives the laser signals from a combat participant which has the armored vehicle 12 under simulated fire. From these signals, information receiver 14 can deduce that armored vehicle 12 is being fired upon. Further, on receipt of the hit-or-miss code from another combat participant, receiver 14 can activate a signal indicating a strike, e.g., by igniting a pyrotechnic smoke display and/or deactivating the laser transmitter-receiver unit 16.

In order to eliminate cable connections between information receiver 14 and the other equipment that is needed for simulating combat firing, the data and command transmission is accomplished by means of optoelectronic communications links. To this end, a light source 14*d*, which may be in the form of a luminous diode or laser diode, or a number of such light sources that can be controlled from analyzer unit 14*c* are provided on the receiver head 14*a*. These light sources then produce a fan of beams 20 that are guided into the inside of the turret 18 by means of one of the periscopes 19 provided on the armored vehicle.

The beams are received in the turret by sensor means so that information which is code imposed on beam 20 can be analyzed and displayed. In this way, the vehicle team can be alerted that they are under simulated fire.

In addition, another beam 20' is produced and aimed at the front end of weapon 17, where it is received by a sensor 15 of the laser transmitter-receiver unit 16. In this way, a deactivation signal can be relayed from the information receiver 14*a* to the laser transmitter-receiver unit 16 when the receiver 14*a* receives a hit signal from another combat participant. The laser transmitter-receiver unit 16 is then switched off so that this armored vehicle 12 drops out as a combat participant.

The team occupying armored vehicle 12 has no way of influencing the optoelectronic transmission link by means of the laser beam 20' and therefore cannot prevent the deactivation of the laser transmitter-receiver unit 16 by tampering in the event of a strike. That such tampering will be prevented is especially assured when the arrangement is such that the laser transmitter-receiver unit 16 remains activated only if the laser beam 20' is maintained continuously or is periodically repeated, and it is deactivated immediately whenever the laser beam 20' is interrupted, either by a hit signal that has been received or by covering sensor 15, for example.

Another communications link 20'' can be provided from the light source 14*d* so that a hit signal device 21, preferably mounted on the lower end of cannon barrel 17, can be activated on receipt of a hit signal. For example, device 21 may ignite a pyrotechnic charge to produce a smoke display in the event of a strike.

Obviously, the three separate beam bundles 20, 20', 20'' can be replaced by a single beam that is fanned out in the vertical plane and is differentially coded according to the different functions.

FIG. 2 shows an example of how an armored vehicle 12 according to FIG. 1 can be positioned as the target object in the path of a laser beam 2 generated by another combat participant. Laser beam 2 is subdivided in the known manner into nine matrix-like fields which are lighted up by the laser transmitter simultaneously or in succession with different codes. The code of the laser light reflected by the reflector elements 13 on armored vehicle 12 thereby indicates the position of the reflectors in one or more of the matrix fields 2', 2'', and thus the position of the target object with respect to the middle line of the beam can be determined.

In this example, the middle field 2' is assumed to be the strike-effective zone according to the simulation. However, as shown, the weapon is aimed so that the reflector elements 13, which are shown as "x's" for the sake of simplicity, are struck by the beams from the lower fields 2''. Since the strike-effective field 2' is not located on the vulnerable points 13, but instead is aimed too high, the simulated shot in this case is evaluated as a miss, unless some other conclusion would be reached on the basis of the ballistic trajectory of the particular ammunition simulated.

Despite the fact that this shot is classified as a miss, information receiver 14, on the target vehicle, receives the radiation from laser beam 2 and triggers a display inside the armored vehicle, indicating that the target vehicle is "under fire," so the team occupying the target object can be warned that it is in combat danger.

After tracking the target object 12 by means of the differently coded matrix fields 2', 2'', the entire grid of the nine individual fields is lighted up together, depending on the result of the hit-or-miss evaluation, and switched to the "strike" code. This signal is also received by the receiver 14 of the target object. If the receiver is signalled that target object 12 has been hit, receiver 14 triggers a strike display and deactivates the firing simulation device on the target object.

FIG. 3 shows another example. The target vehicle 12 is located outside a tracking laser beam 9 which in this case has 25 different coded fields and also has boundary zones 7, 7'. These boundary zones can be coded with the codes "under fire" and/or "strike." The mounting sites for reflector elements 13 that are marked as "x's" represent the combat zone or vulnerable area for purposes of training practice. In the case depicted here, the marksman has aimed too high at the right and missed by shooting past the target. Nevertheless, the all-round receiver 14 of the vehicle 12 can receive the laser beam at least from the boundary zones 7, 7' and, as described with reference to FIG. 2, trigger a display inside the vehicle indicating "under fire."

FIG. 4 shows a target vehicle 12 which is operated partially under cover, e.g., behind a dune. As shown here, the target vehicle 12 is being tracked with a laser beam grid that is subdivided very finely into 10×10 fields. Since the vulnerable zone of the target vehicle 12 which carries the reflector elements 13 is under cover, no laser beams are reflected back to the attacking vehicle, so no strike signal is generated, even though the alignment with the weapon is correct. Nevertheless, the elevated all-round receiver 14 receives the laser radiation and triggers the signal "under fire." According to combat simulation, this vehicle command trainee is rewarded. He cannot be attacked because the reflector elements 13 are under cover and are not in the line of fire due to the trainee's good choice of position. However, the trainee can still participate actively in the firing according to the training drill.

The example of FIG. 4 shows especially clearly the advantage that can be achieved with the device according to this invention for training drills in troop training progams. This is based on the principle of spatially separating the laser beam signal paths for "tracking the target" from those for "transmitting firing and hit-or-miss information."

Another advantage of the system according to this invention is that no particular expense is required to vary the location of the vulnerable area or combat zone on the target vehicle by selecting different locations for attaching the reflector elements 13. This was virtually impossible with the devices known in the past, because the reflector elements were previously combined with receiver elements and were therefore very heavy and sensitive components which required a complicated system of holders and cables. Each type of armored vehicle required different types and lengths of cables. Further, these complicated devices could be easily damaged in the vulnerable mounting zone.

The simple reflector elements 13 used in connection with this invention are separate from the receiver 14 in the desired combat zone. For example, reflector elements 13 can be easily be mounted in the desired combat zone along the anchor guard plate of an armored vehicle. In FIG. 6, a standard triple reflector 50 is shown for reflecting of a laser beam 3 back in the direction of its source. The triple reflector 50 is preferably embedded in a shock-absorbing and vibration-absorbing cushion 54 which is mounted undetachably on a guard plate 53 or a similar plate or sheet-like part of the target vehicle by means of a clamp 51 with a self-tapping screw mount 52. The cushion 54 which holds the triple reflector 50 may be made of rubber, for example, but it can also be permanently connected to part 53 in some other way, such as by gluing, vulcanizing, etc. The reflectors 13 are inexpensive and insensitive parts which can be classified logistically as disposable material.

In addition to the data transmission from the receiver 14, which can be accomplished by means of an optoelectronic communications link 20' without the use of cables, the laser transmitter-receiver unit 16 that is housed in the front end of the cannon also requires a supply line for electricity as well as a line for relaying the triggering signal for the simulated shot. This triggering signal is preferably generated by means of the firing button on the weapon. For this purpose, FIG. 1 shows a cable 11 which may be looped several times around the tube 17, for example, and can be connected to laser transmitter-receiver unit 16 by means of an externally mounted plug connector.

Instead, a completely cableless arrangement is also possible, as indicated in FIG. 5. The laser transmitter-receiver unit 16 here is equipped with batteries (not shown) so that no cables are necessary for supplying electric power. The firing command for the simulated shot, which is generated by means of the real firing button 24 on the weapon, is transmitted by optoelectronic means as follows. While the design and handling of the breech mechanism 23 of the weapon 17 remain completely unchanged, a dummy cartridge 25 instead of a real shell or cartridge is inserted into the breech chamber. Dummy cartridge 25 has at its front end a light source 26, such as a signal light or luminous diode, for example, which can be illuminated briefly by means of the ignition circuit by operating the real firing button 24 on the weapon. In the barrel 17 of the weapon, this optical signal is then transmitted to a sensor 27 at the rear end of the laser transmitter-receiver unit 16 and triggers the transmission of the laser signals for the simulated shot.

The dummy cartridge 25 can be copied exactly from an actual ammunitions unit and may be made of an insensitive material with a suitable weight, e.g., polyurethane with weight inserts. In this way, the weapon loading activity of the marksman can be included in the combat training. If this is not desired, a lightweight cartridge bottom 46 with a corresponding light source 26' can simply be used instead of the dummy cartridge 25.

The arrangement shown in FIG. 5 has the special advantage for the commander and/or marksman trainee that the presence of the firing simulation device does not appear as a change in the weapon at all. Instead, operation of the firing simulation device requires all of the handling of the actual weapon according to training procedures and cannot be manipulated by unauthorized persons. In particular, it is not necessary to leave the breech mechanism of the weapon open in a simulated shot, contrary to actual combat conditions, although this was necessary with the devices known in the past that had a cable connection running through the barrel of the weapon. In the arrangement according to FIG. 5, the simulated shot is triggered by procedures identical to those required for actually firing the weapon, namely, loading the dummy cartridge, closing the breech and operating the firing button 24.

Figure 7:
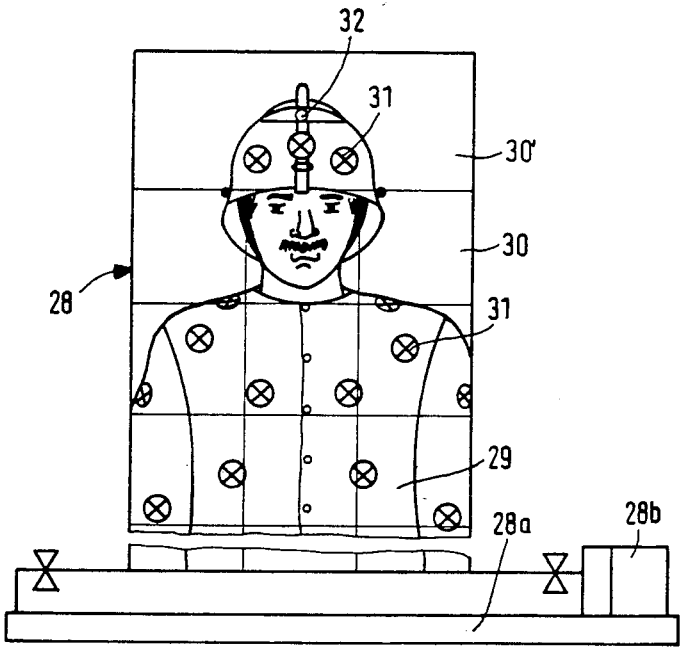
FIG. 7 shows a target according to this invention for an infantry marksman.

FIG. 7 shows a target diagram for an infantry firing simulator as a so-called bobbing target 28 with a base **28*a* and with a drive mechanism 28*b* to improve the infantryman's reaction time. The target has the image 29** of a soldier which appears as a target in the field of vision of a laser beam 30, generated in a 9×9 matrix by a firing simulator. Laser beam 30 has an additional sector 30' for the upper area, although this could also be at the side or bottom, to enlarge the "strike" area of the laser signal.

The reflector elements 31 distributed in a suitable arrangement over image 29 here consist of familiar inexpensive reflecting film or cat's eyes. The "hit" signal, which causes the target to flip back, is transmitted by the information receiver 32 which is located on the helmet of the soldier shown here.

According to FIG. 8, the marksman trainee is wearing a vest 33, which preferably also includes arms. The vest is made of a reflective material (e.g., plastic film) or has pieces of reflective film 31 or cat's eye reflectors 31 provided on it. The reflector elements 31 may alternatively consist of finely divided glass prisms or glass beads which are embedded in plastic material and reflect the incident light beam back to its source. The target (FIG. 7) as well as the items of clothing 33 and helmet 37 of the combat participants may be completely covered with reflective material.

The laser firing simulators known in the past for infantry training are functionally similar to those used for heavy weapons. Again, these simulators possess various shortcomings. For example, additional annoying equipment, such as a backpack for carrying electronic components and/or connecting cables, was required. These cables were necessary for the power supply and for transferring data to individual sensors mounted on the helmet and/or to sensors located on the body. This cumbersome equipment resulted in substantial inconvenience in handling and using these training devices in the field.

In the version shown in FIG. 8, as in FIG. 1, the functions of "target tracking and evaluating" and "information transmission" are separated for the purpose of passivation. The marksman has a weapon 34 which is fitted with a cableless, self-supplying laser transmitter-receiver unit 35. Assembly can be accomplished by means of mounting devices which are standard for telescopic sights, such as dovetails, etc. The marksman can participate in the training combat as long as he is not eliminated himself. The elimination of a participant takes place as in the version shown in FIG. 1 by transfer of a strike signal from another combat participant, shown as an incident laser beam according to the arrow 36.

For receipt of the strike or hit signal, an all-around receiver 40 is provided on the helmet 37 of the marksman where it is mounted by means of simple mounting device 38, such as a rubber strap. The holder for the receiver also includes batteries to supply power to a microminiaturized electronic circuit. An incoming "strike" signal 36 is picked up by the all-around receiver 40 and turns off a light source 42, such as a luminous diode, which is also mounted on the helmet 37. This light source 42 transmits a signal by means of a beam bundle 43, preferably coded, to a sensor 44 on the firing simulator unit 35 that is mounted on the weapon 34. The firing simulator 35 remains active only until the light source 42 is turned off by a strike signal which is received by the receiver 40.

This system of deactivating the firing simulator unit 35 prevents any tampering by the infantryman. Because the unit is deactivated by the absence of the light source, the infantryman cannot prevent deactivation or reactivate firing simulator unit 35, such as by covering light source 42 or sensor 44. Once the infantryman is "hit," he is eliminated from the military maneuver and he can do nothing to prevent this. This is an important advantage in comparison with proposals made in the past, in which, for example, the strike signal causes an acoustic signal to be triggered. This signal could be turned off again when the trainee marksman assumes a supine position, for example, or by means of a key. Thus, prior simulation systems did not assure elimination of the trainee from combat maneuvers even though the trainee had received a simulated hit.

With the simulator according to this invention, reactivation of the firing simulator unit takes place exclusively by having the supervisors or referees use a key or switch latch. If a so-called optical remote control unit, such as those already known, is used for reactivation, then to prevent consumption of electricity, a photoelectric element such as a silicon or selenium cell may be provided to receive the specially coded signal for reactivation and perform the switching operation accordingly.

The foregoing description has been directed to particular embodiments of the invention in accordance with the requirements of the patent statutes for the purposes of illustration and explanation. It will be apparent, however, to those skilled in this art, that many modifications and changes in the apparatus set forth will be possible without departing from the scope and spirit of the invention. It is intended that the following claims be interpreted to embrace all such modifications and changes.

What is claimed is:

1. A device for simulating firing combat between combat participants each of which is either a weapon carrier, a target object, or both, the device comprising, in association with the weapon carrier, laser transmitter means for transmitting laser pulses to track the position of the target object, optical measurement receiver means for receiving the tracking laser pulses reflected by the target object, analyzer means for analyzing from the reflected laser pulses information concerning hit accuracy, and means for transmitting the hit accuracy information to the target object by coded laser pulses, the device further comprising, in association with the target object, reflector element means for reflecting the tracking laser pulses, at least one optical information receiver means for receiving the coded laser pulses, and means coupled to the optical information receiver means for evaluating the hit accuracy information transmitted by the coded laser pulses, the reflector element means being separate from and located in spaced relationship from the optical information receiver means, at least one display means, and at least one optoelectronic communication link connecting the information receiver means of the target object to at least one of the laser transmitter means of the target object and to the display means of the target object for transmitting data or command signals responsive to the hit accuracy information received by the information receiver means.

2. The device according to claim 1, wherein the reflector element means is located in the vulnerable area of the target object and the information receiver means is positioned at an exposed location outside the vulnerable area of the target object.

3. The device according to claim 2, wherein when using the device on an armored vehicle, the reflector element means comprises a plurality of reflector elements placed in the vicinity of the running gear and the information receiver means is located on a stand projecting above the turret of the vehicle.

4. The device according to claim 1, 2 or 3, wherein the reflector element means comprises a plurality of reflector elements mounted on removable holders.

5. The device according to claim 1, wherein the reflector element means comprises a plurality of reflector film elements.

6. The device according to claim 1, wherein each combat participant is a weapon carrier and a target object simultaneously, the reflector element means comprises a plurality of reflector elements, and the laser transmitter means and optical measurement receiver means which are combined in one laser transmitter-receiver unit.

7. The device according to claim 6, wherein the information receiver means has a controllable light source means for transmitting a light signal for deactivating the laser transmitter-receiver unit on receipt by the information receiver means of a strike signal relayed by another combat participant, and the laser transmitter-receiver unit has an optical sensor means for receiving the light signal.

8. The device according to claim 7, wherein the light source means continuously or periodically transmits an activating light signal to the laser transmitter-receiver unit, and on receipt of a strike signal, the information receiver means terminates the transmission of the activating light signal whereby the laser transmitter-receiver unit is deactivated by the absence of the activating signal.

9. The device according to claim 6, wherein the information receiver means has a light source means for transmitting coded light signals upon receipt by the information receiver means of tracking laser pulses from another combat participant, and the device further comprises periscope means for deflecting the coded light signals into the interior of the target object and a firing display means in the interior of the target object for receiving and displaying the coded light signals.

10. The device according to claim 6, wherein the information receiver means has an associated light source means for transmitting a light signal upon receipt of a hit signal by the information receiver means from another combat participant, and the device further comprises a hit display means for receiving the light signal and for producing in response thereto a hit display.

11. The device according to claim 6, further comprising a laser pulse triggering optoelectronic transmission link connecting the standard firing button of the weapon to the transmitter-receiver unit whereby transmission of the laser pulses is triggered by operating the firing button.

12. The device according to claim 11, wherein the laser transmitter-receiver unit is mounted in the front end of the barrel of the weapon, the optoelectronic transmission link is generated by a light source mounted on a dummy cartridge placed in the breech chamber of the weapon, the light source being activated by operating the firing button, and the laser transmitter-receiver unit has sensor means positioned in the barrel of the weapon for receiving the optical triggering signals.

13. The device according to claim 6, wherein the device is adapted for combat simulation with hand weapons, the reflector elements being located on the body of the marksman, the information receiver means being located on his helmet, and the laser transmitter-receiver unit being located on the weapon.

14. The device according to claim 13, further comprising a light source means controllable by the information receiver means for transmitting an activating light signal to the laser transmitter-receiver unit and an optical sensor means associated with the laser transmitter-receiver unit for receiving the activating light signal when the weapon is held in the normal firing position.

* * * * *